US007946066B2

(12) United States Patent
Wamsley

(10) Patent No.: US 7,946,066 B2
(45) Date of Patent: May 24, 2011

(54) SIGN HOLDER AND SIGN DISPLAY SYSTEM

(75) Inventor: Stephen D. Wamsley, Lakewood, OH (US)

(73) Assignee: Fasteners For Retail, Inc., Cleveland, OH (US)

( * ) Notice: Subject to any disclaimer, the term of this patent is extended or adjusted under 35 U.S.C. 154(b) by 813 days.

(21) Appl. No.: 11/899,332

(22) Filed: Sep. 5, 2007

(65) Prior Publication Data

US 2009/0056185 A1 Mar. 5, 2009

(51) Int. Cl.

| | |
|---|---|
| ***A47G 7/00*** | (2006.01) |
| ***A47G 29/10*** | (2006.01) |
| ***A47G 1/08*** | (2006.01) |
| ***G09F 7/00*** | (2006.01) |
| ***G09F 15/00*** | (2006.01) |
| ***G09F 15/02*** | (2006.01) |
| ***G09F 3/18*** | (2006.01) |

(52) U.S. Cl. ..... 40/657; 40/606.19; 40/611.06; 40/607.13; 40/606.13; 40/741; 40/611.12; 40/642.02; 40/605; 40/607.02; 248/220.31; 248/220.41; 248/220.42; 248/74.2; 248/221.12

(58) Field of Classification Search ..... 40/657, 40/606.19, 611.06, 607.13, 606.13, 741, 40/611.12, 642.02, 605, 607.02; 248/220.31, 248/220.41, 220.42, 74.2, 221.12
See application file for complete search history.

(56) References Cited

U.S. PATENT DOCUMENTS

| | | | | |
|---|---|---|---|---|
| D381,041 | S | 7/1997 | Lammers et al. | |
| 5,664,749 | A | 9/1997 | Kump et al. | |
| 5,671,852 | A * | 9/1997 | Maharg | 211/189 |
| D397,366 | S | 8/1998 | Wamsley | |
| 6,014,828 | A * | 1/2000 | Kern et al. | 40/492 |
| 6,026,603 | A | 2/2000 | Kump et al. | |
| D423,592 | S | 4/2000 | Wamsley | |
| 6,289,618 | B1 | 9/2001 | Kump et al. | |
| D453,534 | S | 2/2002 | Kosir | |
| D453,798 | S | 2/2002 | Gray | |
| D454,373 | S | 3/2002 | Kosir | |
| D454,593 | S | 3/2002 | Kosir | |
| D454,917 | S | 3/2002 | Mueller | |
| D454,918 | S | 3/2002 | Wamsley et al. | |
| 6,450,471 | B1 * | 9/2002 | Wear | 248/489 |
| D480,949 | S | 10/2003 | Kosir | |
| D487,115 | S | 2/2004 | Kosir | |
| D487,290 | S | 3/2004 | Kosir | |
| 6,698,124 | B2 * | 3/2004 | Kump et al. | 40/642.02 |
| D511,548 | S | 11/2005 | Wamsley | |
| D516,633 | S | 3/2006 | Kosir | |
| 2006/0130381 | A1 * | 6/2006 | Caterinacci | 40/607.04 |

OTHER PUBLICATIONS

FFR Yellow Pages 2007 Product Catalog, Cover page, pp. 34, 35, 125, 126 and 130.

* cited by examiner

*Primary Examiner* — Joanne Silbermann
*Assistant Examiner* — Syed A Islam
(74) *Attorney, Agent, or Firm* — Fay Sharpe LLP

(57) ABSTRACT

A sign holder holding an end of each of two signs includes a first wall, a second wall spaced from the first wall, and a connecting wall located between the first and second walls and secured thereto. A first sign holding section is defined by first portions of the first and second walls and is located on a first side of the connecting wall. A second sign holding section is defined by second portions of the first and second walls and is located on a second side of the connecting wall. A channel is defined on the second wall for engaging an associated bracket used to mount the sign holder on a support.

22 Claims, 11 Drawing Sheets

SIGN HOLDER AND SIGN DISPLAY SYSTEM

BACKGROUND OF THE INVENTION

The invention relates generally to sign holders. More particularly, the present invention relates to a point of purchase sign holder which provides information concerning a package or item located adjacent the sign holder.

Shelving structures and related display units for displaying merchandise are a common sight in any type of store or commercial establishment. The desire of any merchant is and always has been to draw a shopper's attention to the items the merchant is offering for sale.

Vertically extending pegboard surfaces are particularly effective for displaying small, high volume merchandise on hooks and other horizontally extending fasteners. Such pegboard display systems have long been popular with retail merchants. The pegboard support has a matrix of uniformly spaced holes that can receive product support devices such as display hooks. These display hooks have a base including one or more tab shaped prongs which extend rearwardly of the base and engage selected mounting holes in the matrix of holes formed in the pegboard support. When mounted at desired positions on the display surface, the display hooks project forwardly thereof to hold merchandise.

Of course, there are also a wide variety of known shelving displays as well. The merchandise displayed in each of these ways may require that certain information be displayed (e.g. price, promotional, or other product information). This is generally done by sign holders. A variety of sign holders and methods of attachment are known for securing those sign holders to various supporting merchandise structures (e.g. pegboard, slatwall, gondola upright shelf supports, warehouse upright rack supports, etc).

In a first type, a sign holder is mounted to a pegboard support surface or other similar material of a merchandise fixture via a mounting base or bracket. An arm may extend perpendicularly from the base or bracket and include a display plate or sign holding portion for holding an associated sign. Typically, only one end of the sign is secured which may result in the sign being jarred loose by a passing individual. Furthermore, the length and overall size of the sign is limited due to the relatively low load carrying capability of these types of sign holders.

In another design, the sign holder typically includes first and second sign engaging portions that are spaced apart from one another so as to hold opposing corners of the sign. This type of sign holder is typically designed to be secured atop and parallel to a longitudinal axis of the associated merchandise fixture. However, these systems are not designed to be used with pegboards or various other merchandising, fixtures nor can they support a series of signs connected end to end.

Of course, frame-like sign holders are well known. These include several fixed length channel-like sign engaging portions which are spaced apart in a fixed manner by corners. The channels may be oriented to hold one or more signs in a series or parallel configuration. However, in these systems the spacing between the channels or sign engaging portions is not adjustable and thus the user is confined to using signs of a particular dimension.

Accordingly, it has been considered desirable to develop a new and improved sign holder and sign display system which would overcome the foregoing difficulties and others while providing better and more advantageous overall results.

BRIEF DESCRIPTION OF THE INVENTION

In accordance with one aspect of the present invention, a sign holder is provided for holding an end of each of two signs. The sign holder includes a first wall, a second wall spaced from the first wall, and a connecting wall located between the first and second walls and secured thereto. A first sign holding section is defined by first portions of the first and second walls and located on a first side of the connecting wall. A second sign holding section is defined by second portions of the first and second walls and located on a second side of the connecting wall. A channel is defined on said second wall for engaging an associated bracket used to mount the sign holder on a support.

In accordance with another aspect of the present invention, a display system for selectively attaching an associated sign to an associated merchandise fixture is provided. The system includes a first bracket including a first fixture engaging protrusion for selectively engaging an opening in a first portion of the associated merchandise fixture. A first sign holder is provided including a bracket engaging portion and a sign engaging portion, the bracket engaging portion of the first sign holder is capable of being selectively mounted to the first bracket and the sign engaging portion releasably holds a first end of an associated sign. A second bracket is provided including a fixture engaging protrusion for selectively engaging an opening in a second portion of the associated merchandise fixture. A second sign holder is provided including a bracket engaging portion and a sign engaging portion. The bracket engaging portion of the second sign holder is capable of being selectively mounted to the second bracket and the sign engaging portion releasably holds a second end of the associated sign. Wherein the first and second brackets and the first and second sign holders cooperate to removably secure the first and second sides of the associated sign to the associated merchandise fixture.

In accordance with still another aspect of the present invention, a display system is provided for selectively attaching an associated sign to an associated merchandise fixture. The associated merchandise fixture includes an associated shelf for displaying merchandise. The associated shelf includes a generally horizontal panel and a forward facing panel. The system includes a first bracket including a generally planar support and an engaging member. The engaging member of the first bracket selectively engages a first portion of the associated merchandise fixture. A first sign holder is provided including a bracket engaging portion and a sign engaging portion. The bracket engaging portion of the first sign holder is capable of being selectively mounted to the generally planar support of the first bracket and the sign engaging portion is adapted to receive a first end of the associated sign. A second bracket is provided including a generally planar support and an engaging member. The engaging member of the second bracket selectively engages a second portion of the associated merchandise fixture. A second sign holder is provided including a bracket engaging portion and a sign engaging portion. The bracket engaging portion of the second sign holder is capable of being selectively mounted to the generally planar support of the second bracket and the sign engaging is adapted to receive a second end of the associated sign. Wherein the first and second brackets and the first and second sign holders cooperate to removably secure the first and second sides of the associated sign to the associated merchandise fixture.

Still other aspects of the invention will become apparent from a reading and understanding of the detailed description of the preferred embodiments hereinbelow.

BRIEF DESCRIPTION OF THE DRAWINGS

The present invention may take physical form in certain parts and arrangements of parts, preferred embodiments of which will be described in detail in this specification and illustrated in the accompanying drawings which form a part of the invention.

DETAILED DESCRIPTION

Figure 1:
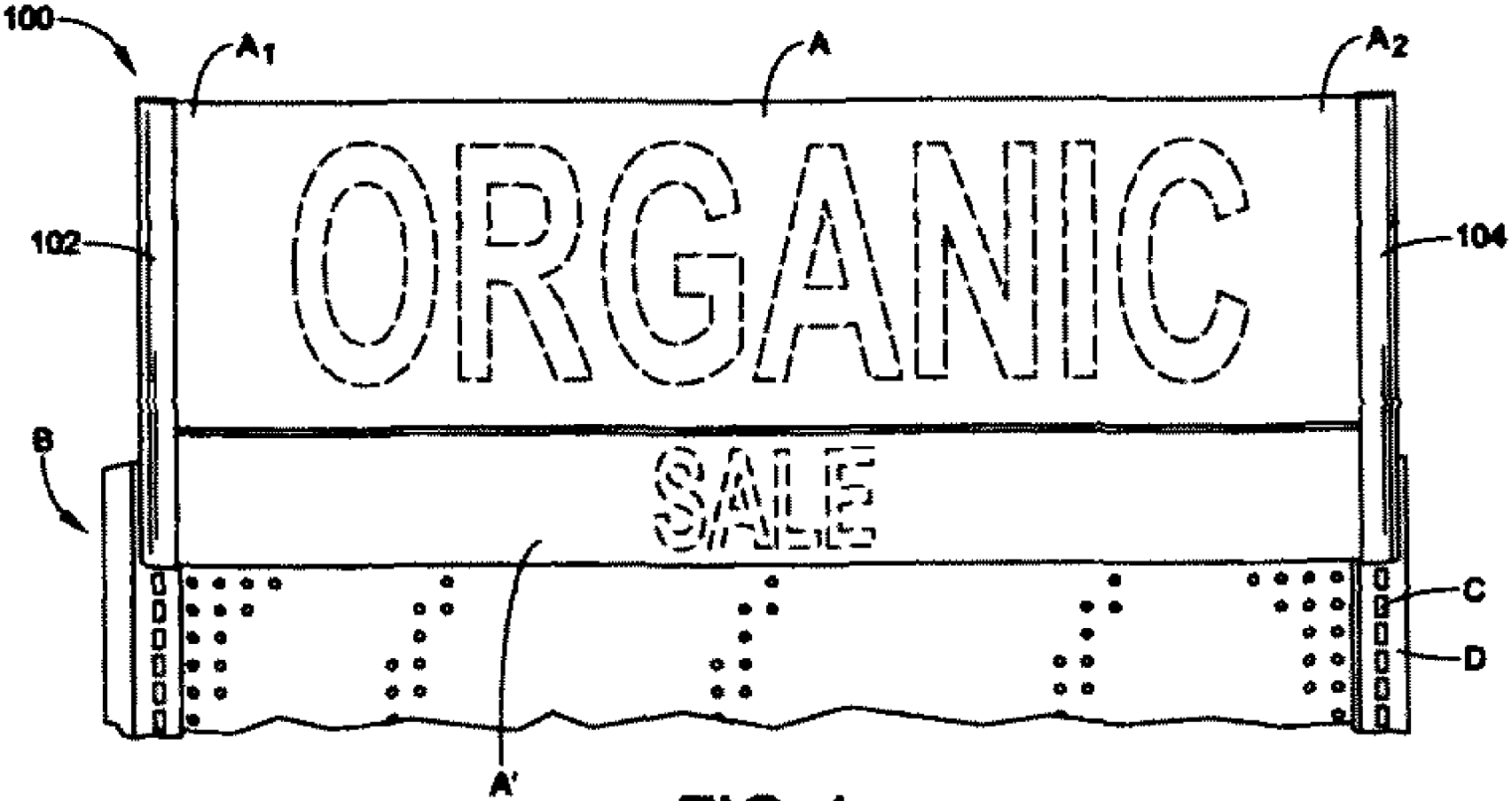
FIG. 1 is a front elevation view of a first embodiment of a sign display system, according to the present invention, illustrating a pair of sign holders mounted to a gondola upright fixture for supporting a sign.
Figure 2:
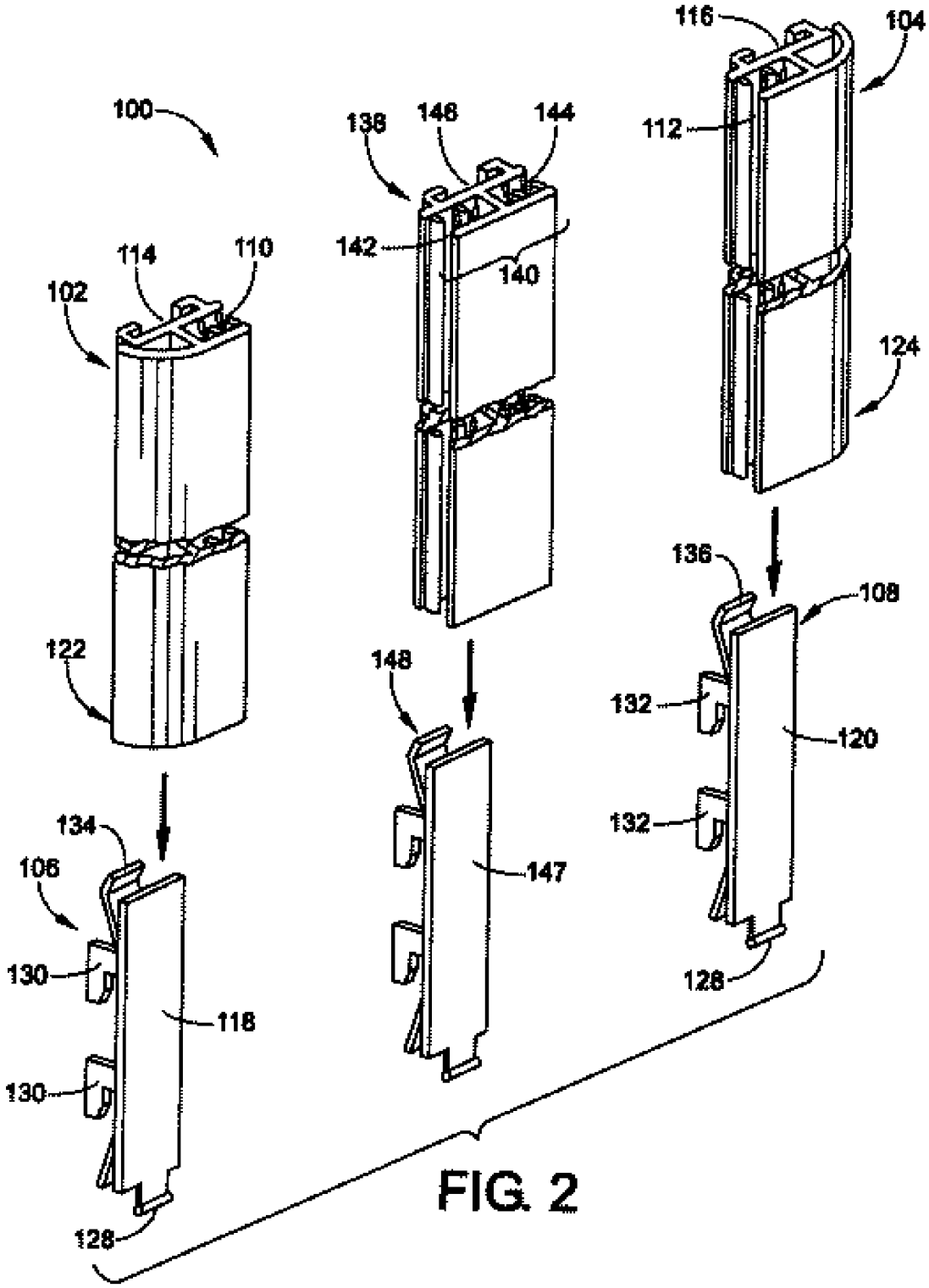
FIG. 2 is an exploded perspective view of the sign display system of FIG. 1, according to the present invention, illustrating a first, second, and intermediate sign holder and a first, second, and intermediate bracket for selectively attaching each sign holder to the associated merchandise fixture.

Referring now to the drawings, wherein the showings illustrate the preferred embodiments of the invention only and are not intended to limit same, FIGS. 1-2 illustrate a display system 100 for mounting one or more associated signs A, A' to an associated merchandise fixture B, such as a gondola upright header, in accordance with a first embodiment of the present invention. The display system 100 generally includes a first sign holder 102, a second sign holder 104, a first bracket 106 and a second bracket 108. In addition, the first and second sign holders 102, 104 each include a sign engaging portion 110, 112, as well as a bracket engaging portion 114, 116. The bracket engaging portions 114, 116 may include a T-shaped slot or channel designed to slidably engage a respective generally planar member 118, 120 of the first and second brackets 106, 108.

As indicated by the arrows in FIG. 2, a lower portion 122, 124 of the first and second sign holders 102, 104, may be driven in a downward manner so that the bracket engaging portions 114, 116 slide over the generally planar members 118, 120. Eventually the lower portions 122, 124 of the bracket engaging portions 114, 116 contact a respective stop 126, 128 thus preventing the sign holders 102, 104 from sliding off the brackets 114, 116. Furthermore, the width and or thickness of the generally planar member may be slightly oversized, relative to the bracket engaging portion, such that a light degree of interference between the bracket engaging portion occurs, to prevent the sign holder from being accidentally slid or bumped off the bracket.

With continued reference to FIG. 2, the first and second brackets 106, 108 each further include a fixture engaging protrusion 130, 132 for securely and removably attaching the first and second brackets 106, 108 to the associated merchandise display fixture B. The fixture engaging protrusions 130, 132 can be generally L-shaped. As shown in FIG. 1, they are designed to be received into a rectangular aperture or slot C of an upright support D of the associated merchandise display fixture B. Furthermore, the brackets 106, 108 can include a respective biasing member 134, 136. The biasing members 134, 136 prevent the brackets 106, 108 from being accidentally dislodged by applying a small continuous amount of pressure between the bracket 120 and the upright support D of the merchandise fixture B.

As shown in FIG. 1, a first end $A_1$ of the first associated sign A is received into the sign engaging portion 110 of the first sign holder 102. Next, a second end $A_2$ of the first associated sign A is received into the sign engaging portion 112 of the second sign holder 104. Similarly, a second associated display sign A' can be installed into the sign holders 102, 104 forming a generally parallel set of signs. The sign holders 102, 104 can be made of a coextruded thermoplastic material. With the embodiment disclosed herein, suitable lengths of the extrusion can be cut for the sign holders 102, 104 depending on the height of the one or more signs the merchant wishes to display. Once the brackets 106, 108 (FIG. 2) have been installed on the merchandise fixture B, the first and second sign holders 102, 104 and the signs A, A' may be slid as a single unit down over the planar members 118, 120 (FIG. 2) of the first and second brackets 106, 108 (FIG. 2).

With continued reference to FIG. 2, a third or intermediate sign holder 138 may further be provided in the display system 100 having a dual sign engaging portion 140 for receiving two sign ends. In other words, the dual engaging portion 140 includes a first sign engaging portion 142 for receiving an end of one sign and a second sign engaging portion 144 for receiving an end of another sign. As with the first and second sign holders 102, 104, the third sign holder 138 includes a similar bracket engaging portion 146 that is intended to be slidably received over a generally planar member 147 of a third bracket 148. These can be defined by a pair of spaced walls 149 that can be L-shaped as shown. Looked at another way, the bracket engaging portion of the third sign holder defines two generally C-shaped channels for slidably engaging opposed side edges of the generally planar surface of the third bracket 148. Furthermore, it should be apparent that the first, second, and third brackets can be identical in structure such that the brackets 106, 108, 148 can be used interchangeably with any of the sign holders 102, 104, 138.

Figure 3:
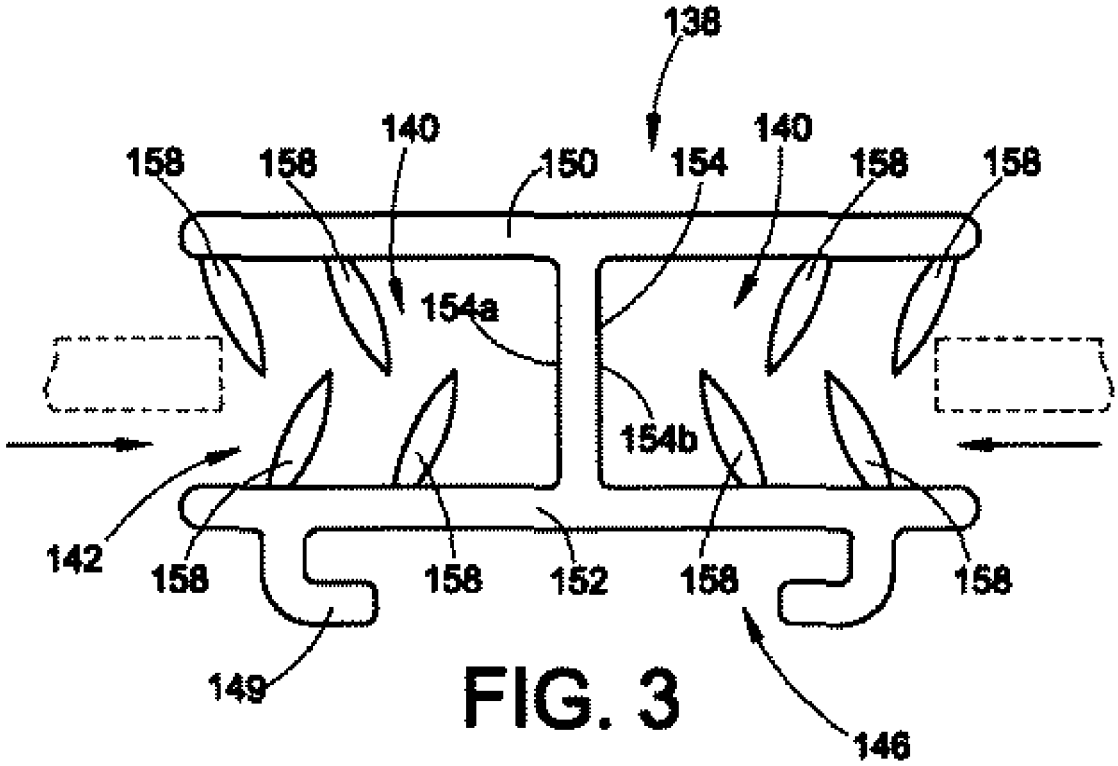
FIG. 3 is an enlarged plan view of the intermediate sign holder of FIG. 2, illustrating a sign engaging portion including first and second plurality of fins or fingers for securely gripping an end of each of two associated signs.

With reference now to FIG. 3, a plan view of the third or intermediate sign holder 138 is shown. Generally, the third sign holder 138 includes a first side wall 150, a second side wall 152 that is spaced apart from the first wall 150, and a third or connecting wall 154 which joins the first wall 150 to the second wall 152. The connecting wall 154 divides the dual sign engaging portion 140 into the first sign engaging portion 142 on a first side 154*a* of the connecting wall 154 and the second sign engaging portion 144 on a second side 154*b* of the connecting wall 154. Furthermore, the first and second sign engaging portions 142, 144 include a first and second plurality of spaced fins 156, 158 each for frictionally engaging an end portion of two separate signs. To this end, the fins 156, 158 are made of a softer more resilient material than are the walls 150-154 of the intermediate sign holder 138. As mentioned, the sign holder can be made via a known coextrusion process. In addition, the first and second set of plurality of spaced fins 156, 158 may be angled inward towards the third or connecting wall 154 to assist in the insertion of a sign end portion and to resist the withdrawal of same. Moreover, the fins 156, 158 can be interdigitated such that the tip portions of the fins attached to the first wall 150 mesh or overlap into the unoccupied space between the opposing fins on the second wall 152. Interdigitating the fins in this manner causes the sign end portion to deflect in a wavy pattern which further enhances the frictional engagement of the associated sign with the sign holder.

Figure 4:
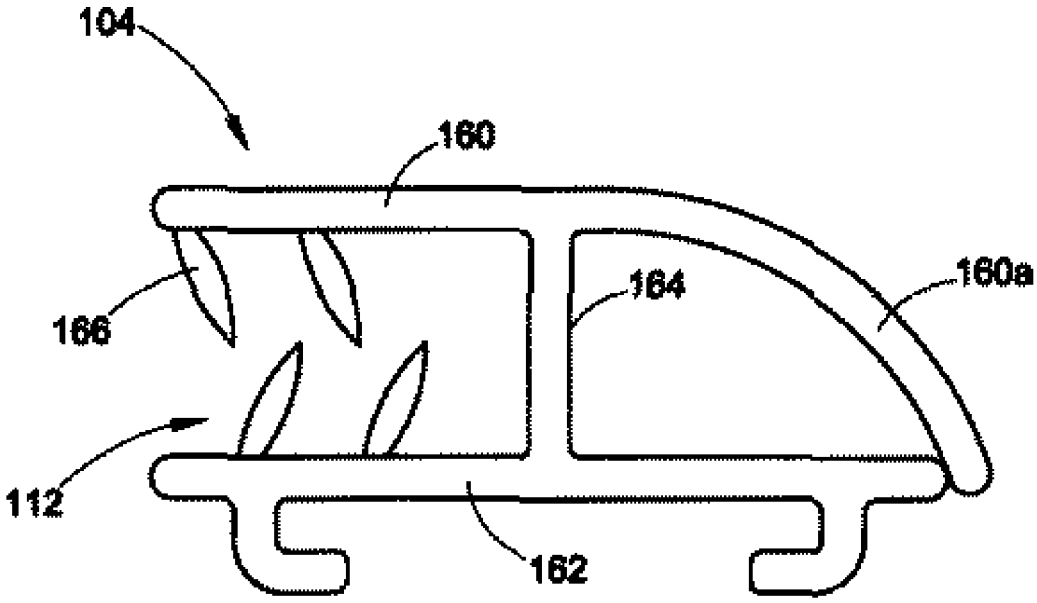
FIG. 4 is an enlarged plan view of the second sign holder of FIG. 2, illustrating a sign holding section including a plurality of fins of fingers for securely gripping one end of the associated sign.

With reference to FIG. 4, the second sign holder 104 includes structural features similar to those of the intermediate or third sign holder 138 (FIG. 3). The first sign holder 102 includes a first side wall 160, a second side wall 162, and a third or connecting wall 164. In addition, the sign engaging portion 110 may include a plurality of spaced and interleaved or interdigitated fins 166 for securely, yet releasably, holding an associated sign. However, the first wall 160 of the first sign holder 102 differs in that it includes a curved portion 160*a* that bends towards the second wall 162. Also, the first sign holder only includes a single sign engaging portion 112. It should also be noted that in the first embodiment, the first and second sign holders are structurally identical and, as such, all of the features discussed herein with respect to the second sign holder are applicable to the first sign holder. Furthermore, due to their structural similarity the first and second sign holders of the first embodiment can be used interchangeably by simply rotating the first or second sign holder 180 degrees with respect to the other.

Figure 5:
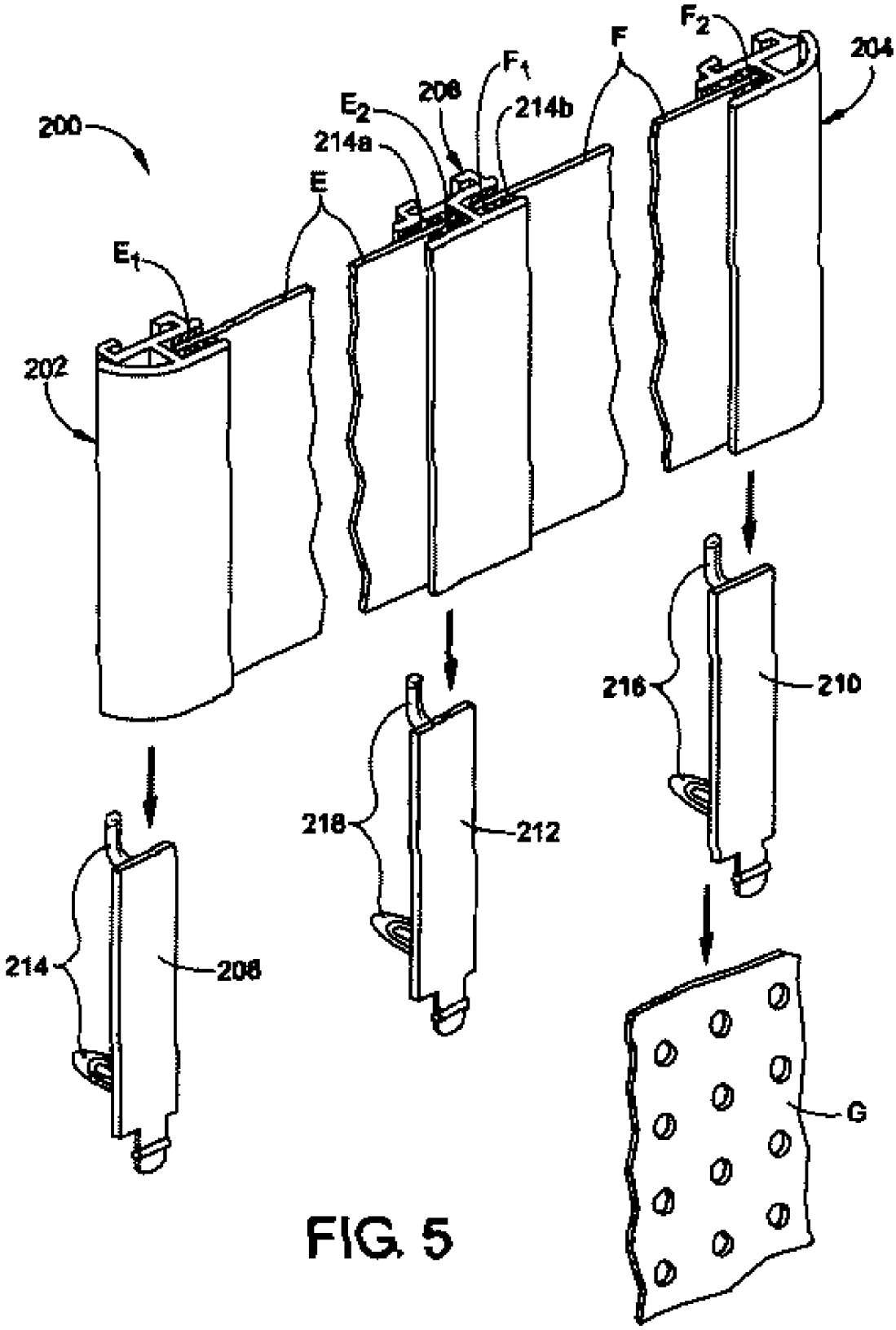
FIG. 5 is an exploded perspective view of a second embodiment of a sign display system including a bracket adapted to engage an associated pegboard merchandise fixture.

With reference to FIG. 5, a second embodiment of a display system 200 is shown having a first, second and third sign holders 202, 204, 206. As with the first embodiment, the sign holders 202, 204, 206 are slidably received onto a first, second and third brackets 208, 210, 212, respectively for the purpose of supporting two or more display signs. As illustrated in FIG. 5, a first associated sign E and a second associated sign F are held between the sign holders 202, 204, 206. In particular, a first end $E_1$ of the first sign E is held by the first sign holder 202 and a second end $E_2$ of the first sign E is held by a first sign engaging portion 214*a* of the third sign holder 206. Similarly, a first end $F_1$ of the second sign F is held by a second sign engaging portion 214*b* of the third sign holder 206 and a second end $F_2$ of the second sign F is held by the second sign holder 204. In this manner, any number of associated display signs can be linked together in a series fashion by placing the third sign holder 206 and the third bracket 212 between the associated signs. This series arrangement of associated signs is also possible with the first embodiment of the display system 100 illustrated in FIGS. 1-2. However, the primary difference between the second embodiment and the first embodiment involves the use of pegboard fixture engaging protrusions 214, 216, 218 on the brackets 208, 210, 212. The pegboard engaging protrusions 214, 216, 218 include an upper and a lower protrusion adapted to be received into a plurality of regularly spaced holes as in a pegboard material G for removably securing the brackets 208, 210, 212 to the associated fixture, in a manner commonly known in the art. It is noted that the protrusions are differently shaped, with the upper protrusion on each bracket being in the form of a hook.

Figure 6:
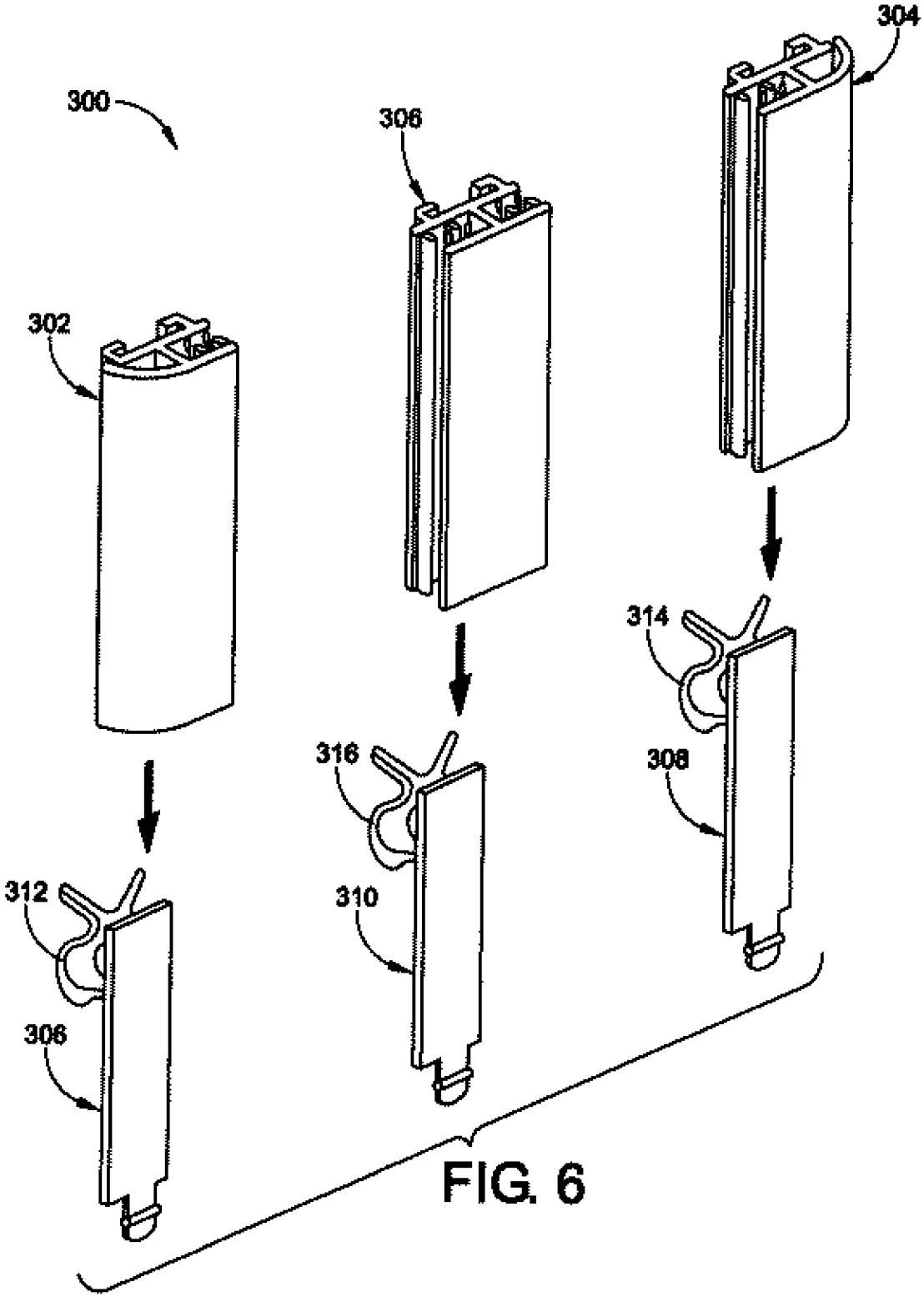
FIG. 6 is an exploded perspective view of a third embodiment of a sign display system including a bracket adapted to engage an associated slatwall merchandise fixture.
Figure 7:
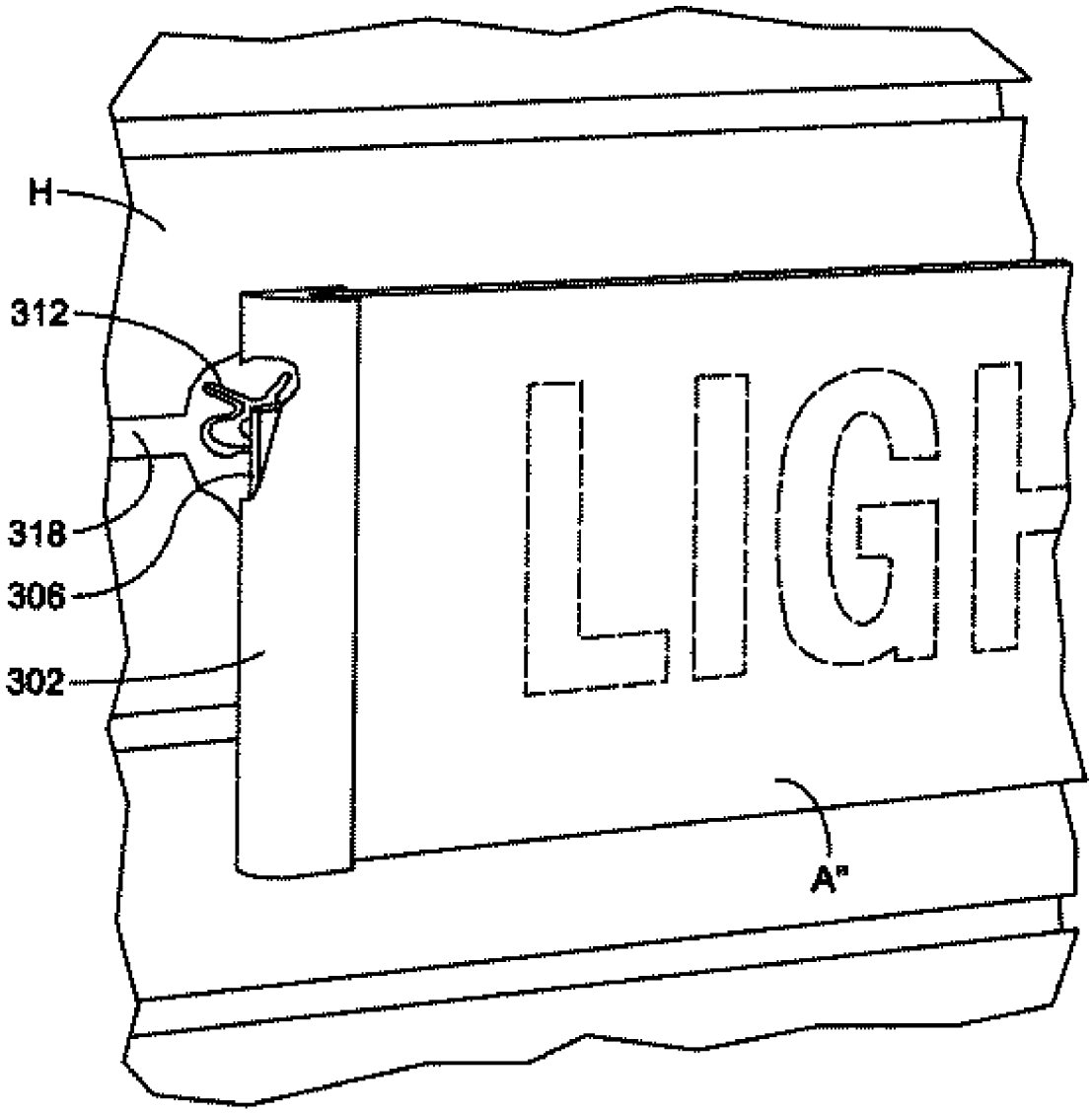
FIG. 7 is a perspective view, partially broken away, of a portion of the associated slatwall merchandise fixture, illustrating the engagement of the bracket of FIG. 6 with a slot channel.

With reference to FIG. 6, a third embodiment of a display system 300 is shown which includes many of the same structural features of the first and second embodiments of the display system 100, 200. As with the previous embodiments, the display system 300 includes a first, second, and third sign holders 302, 304, 306 and corresponding first, second, and third brackets 306, 308, 310. The display system 300 is also capable of receiving a plurality of associated signs in a parallel and or series fashion, as with the previously discussed embodiments. However, the primary difference between the third embodiment and the first embodiment involves the use of slatwall or slatboard fixture engaging protrusions 312, 314, 316 of the brackets 306, 308, 310. With reference to FIGS. 6 and 7, the slatwall engaging protrusions 312, 314, 316 are adapted to be received into a slot 318 provided in an associated slatwall material H for removably securing the brackets 306, 308, 310 to the associated fixture, thus supporting the sign holders 302, 304, 306 and the associated one or more display signs A".

One benefit of this embodiment is that the sign A" can be of any desired width and any desired length and still be accommodated by the display system. In other words, the sign holders 302-306 can be cut to the length necessary for the one or more signs and the brackets 306-310 can be slid apart the desired amount in the slot 318 to accommodate the one or more signs A" as the merchant may require. Also, since the elements of the display system are relatively inexpensive, they can be replaced or adapted for reuse when signs of another size need to be displayed by the merchant.

Figure 8:
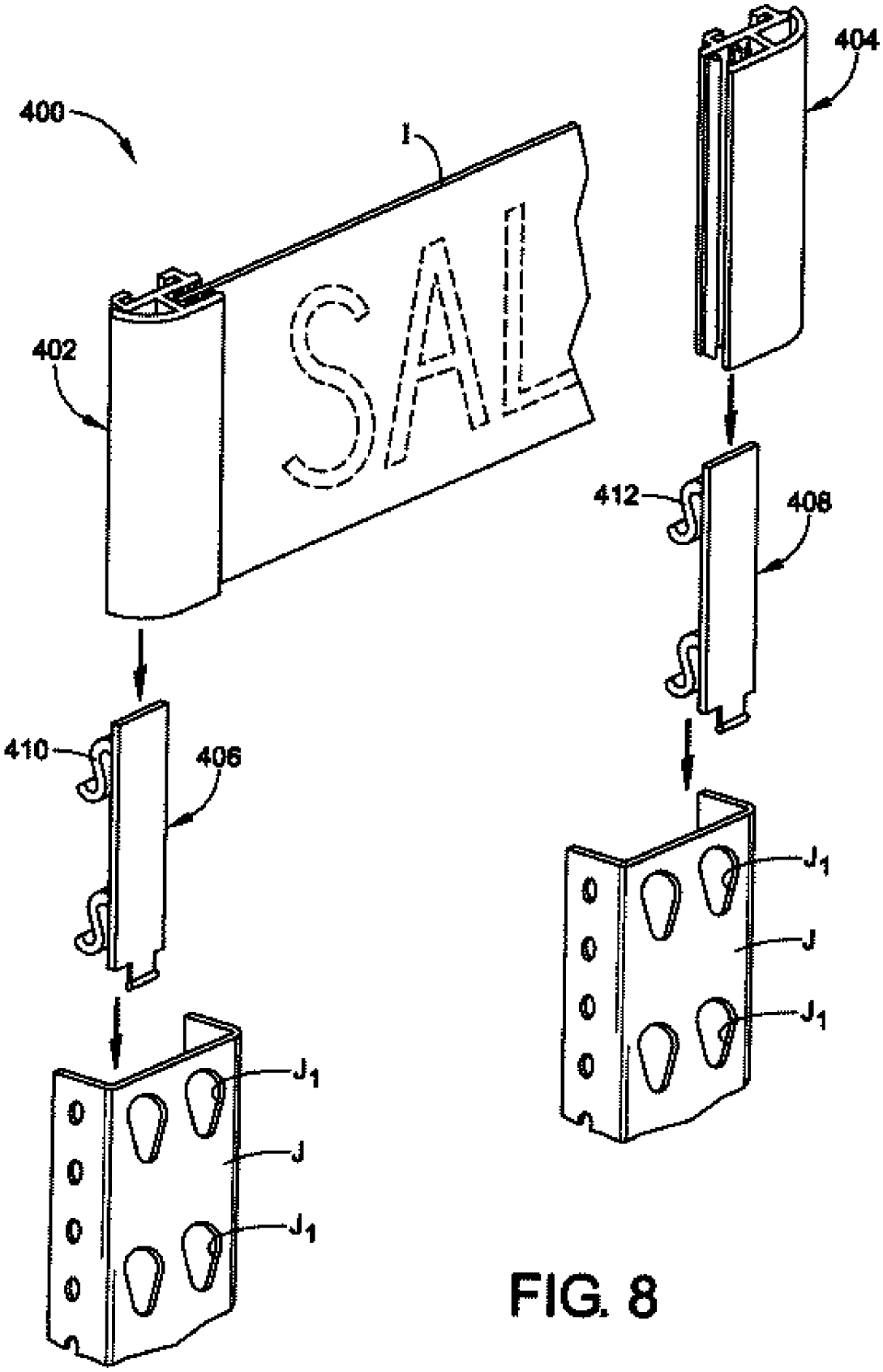
FIG. 8 is an exploded perspective view of a fourth embodiment of a sign display system including a bracket adapted to engage an associated warehouse upright fixture.

Now with respect to FIG. 8, a fourth embodiment of a display system 400 is shown, including first and second sign holders 402, 404 and first and second brackets 406, 408 for securely mounting a sign I to an associated pair of warehouse upright rack supports J. Such upright rack supports J may be found in typical industrial or retail business and or other facilities for storing or displaying various types of product. As before, the fourth embodiment of the display system 400 shares many of the same structural features as those taught by the previously mentioned embodiments. The primary distinction between the display system 400 and the previous embodiments involves the use of a clip type fixture engaging portion 410, 412 of the first and second brackets. The fixture engaging portions 410, 412 are specifically adapted to be received into one or more upright support apertures $J_1$ in the associated upright supports J.

Figure 9:
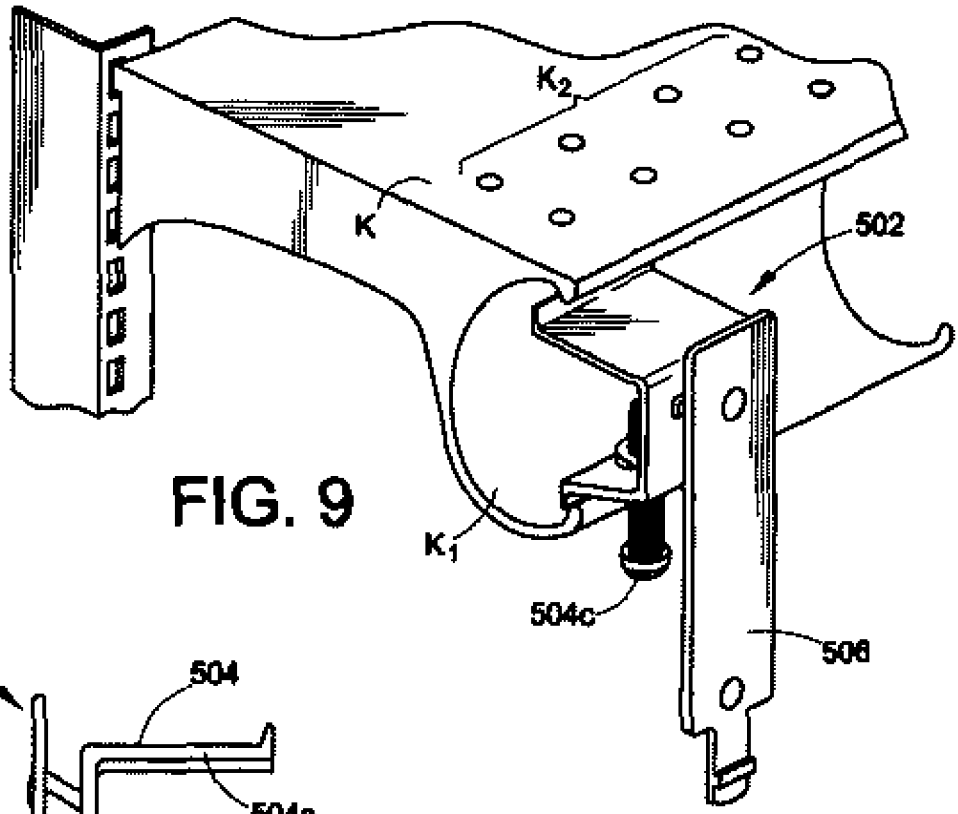
FIG. 9 is a perspective view of a fifth embodiment of a sign display system including a bracket adapted to engage a forward facing panel of a shelf of an associated merchandise fixture.
Figure 10:
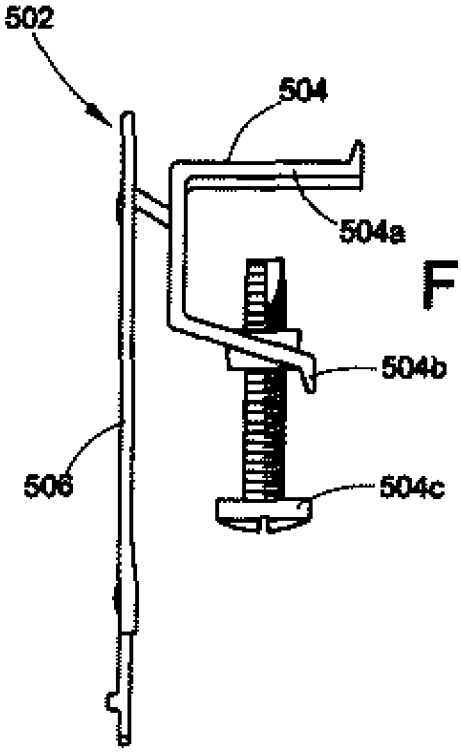
FIG. 10 is an enlarged reverse side elevation view illustrating a threaded fastener for tensioning a clip portion of the bracket of FIG. 9.
Figure 14:
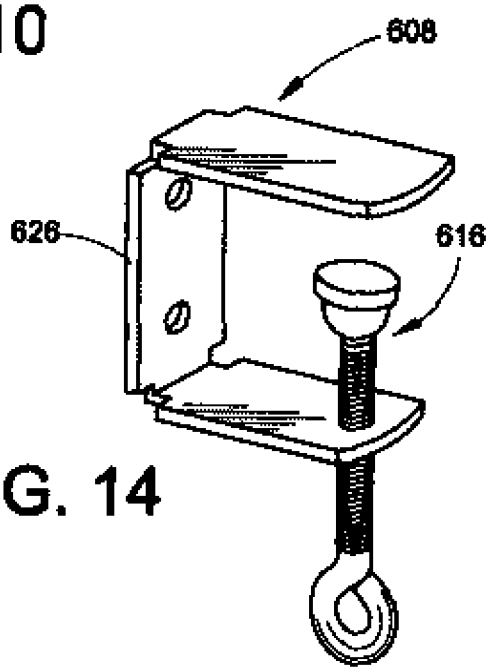
FIG. 14 is a perspective view of an alternate embodiment of a bracket for a sign display system adapted to engage a generally horizontal panel of the shelf of the associated merchandise fixture.
Figure 11:
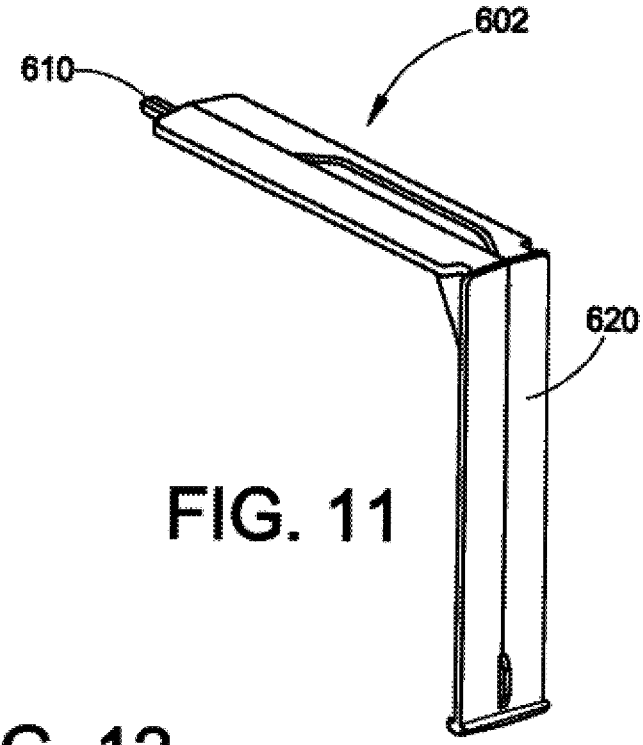
FIG. 11 is a perspective view of an alternate embodiment of a bracket for a sign display system adapted to engage an upper surface of the shelf of the associated merchandise fixture.
Figure 12:
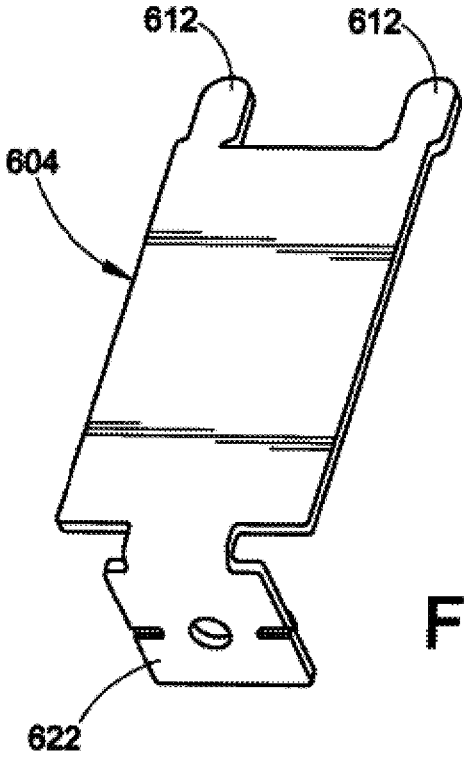
FIG. 12 is a perspective view of an alternate embodiment of a bracket for a sign display system adapted to engage a set of spaced apertures along the upper surface of the shelf of the associated merchandise fixture.
Figure 13:
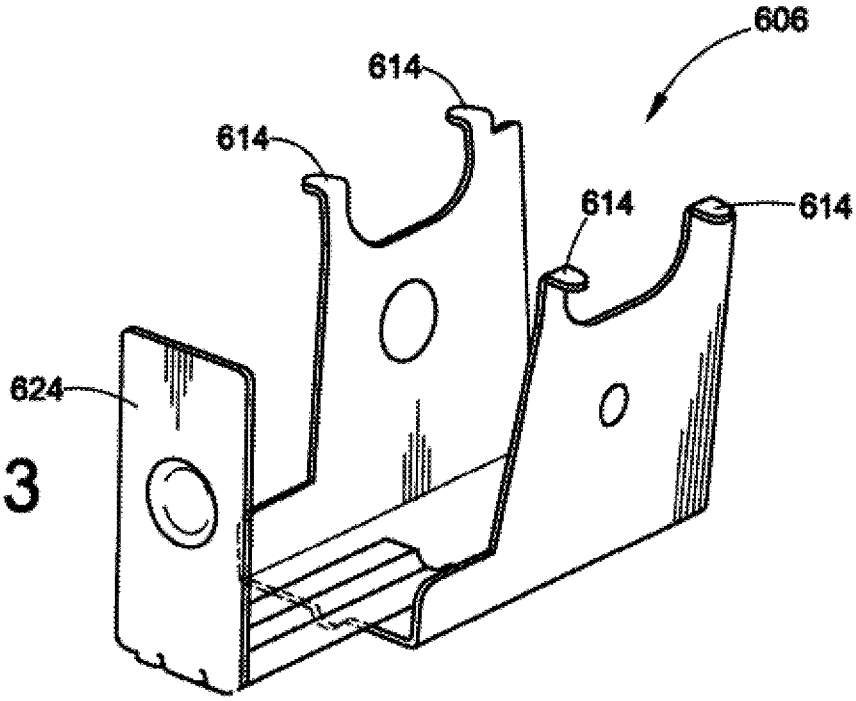
FIG. 13 is a perspective view of an alternate embodiment of a bracket for a sign display system adapted to engage a set of spaced shelf apertures from beneath the shelf of the associated merchandise fixture.

Now with reference to FIGS. 9 and 10, a sign holder bracket 502 is shown for use in a fifth embodiment of a display system. In particular, the bracket 502 includes a C-shaped fixture engaging portion 504 that is designed to engage a shelf K. More particularly, the bracket engages a C-channel K, at the forward edge of the shelf K. As with the previous embodiments, the bracket 502 includes a generally planar member 506 for slidably receiving a sign holder. The fixture engaging portion 504 further includes a first leg 504*a* and a second leg 504*b*. A threaded fastener 504*c* is provided for spacing the first and second legs 504*a*, 504*b* apart so as to securely grip the C-channel K, of the associated shelf. It should be noted that the sign holder bracket 502 is configured to receive any of the sign holders taught with respect to the previous embodiments.

Now with reference to FIGS. 11-14, various alternate embodiments of a sign holder bracket 602, 604, 606, 608 are illustrated for similarly receiving a sign holder and for supporting an associated sign. In particular, the brackets 602, 604, 606 depicted in FIGS. 11-13, include a tab or prong-like fixture engaging portion 610, 612, 614 for engaging one or more spaced apertures $K_2$ (FIG. 9) defined in a forward portion of the shelf K of the associated merchandise fixture. The bracket 608 of FIG. 14 includes a clamp-like fixture engaging portion 616 having a threaded stem 618 for clamping the bracket 608 onto a generally flat portion of the shelf K (FIG. 9) of the associated merchandise fixture. Further still, all of the alternate sign holder brackets 602, 604, 606, 608 include a generally planar member 620, 622, 624, 626 for receiving the first, second, or third/intermediate sign holders of any of the previous embodiments.

Figures 15, 16:
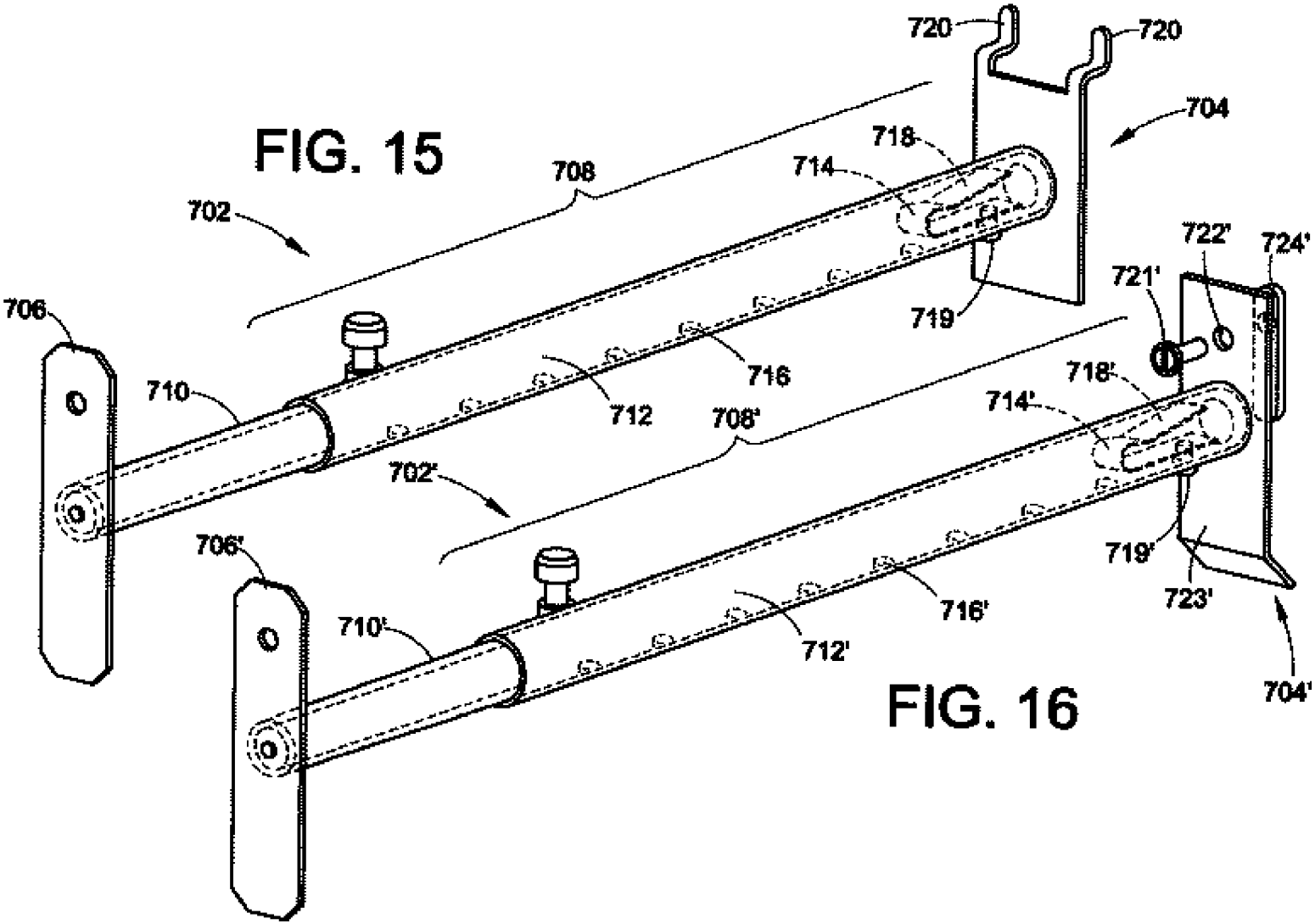
FIG. 15 is a perspective view of an alternate embodiment of a bracket for a sign display system having a telescopic body which is adapted to engage an associated pegboard merchandise fixture.
FIG. 16 is a perspective view of an alternate embodiment of a bracket for a sign display system having a telescopic body which is adapted to engage a slot or tab aperture in a gondola or warehouse upright supports of an associated merchandise fixture.

With reference to FIGS. 15 and 16, two additional embodiments of a sign holder bracket 702, 702' are shown for receiving a sign holder and for supporting one or more associated signs. As in the previously discussed embodiments, the brackets 702, 702' include a fixture engaging portion 704, 704' and a generally planar member 706, 706' for receiving the sign holder. The primary distinction between the brackets 702, 702' of the instant embodiment and the brackets of the previous embodiments involves the use of a telescopic body 708, 708'. The telescopic bodies 708, 708' include a first elongate member 710, 710' that is slidably engaged with a second elongate member 712, 712' for the purpose of spacing the generally planar members 706, 706' (and the sign holders and associated sign attached thereto) apart from the associated merchandise fixture. In addition, the telescopic bodies 708, 708' each include an adjusting assembly 714, 714'. The adjusting assemblies 714, 714' include a series of apertures 716, 716' extending in a longitudinal and spaced apart manner along the second elongate member 712, 712'. A latching member 718, 718' is provided in an end of the first elongate member 710, 710' and includes a button projection 719, 719' for engaging the series of apertures 716, 716'.

The primary difference between the sign holder brackets 702, 702' shown in FIGS. 15 and 16 involves the particular attachment features for securing the sign holder brackets 702, 702' to the associated merchandise display. Specifically, the fixture engaging portion 704 of the bracket 702 includes a pair of projections 720 for engaging in holes of an associated pegboard (such as G in FIG. 5). By contrast, the fixture engaging portion 704' of the bracket 702' utilizes a fastener 720' that can be inserted through an aperture 722' in a base portion 723' to engage a clamping member 724'. The clamping member 724' can be inserted into a slot C (FIG. 1) or any other aperture of the upright support D (FIG. 1) or merchandise fixture so as to securely clamp the base portion 723' of the bracket 704' against the merchandise fixture when the fastener 720' is tightened.

Figure 17:
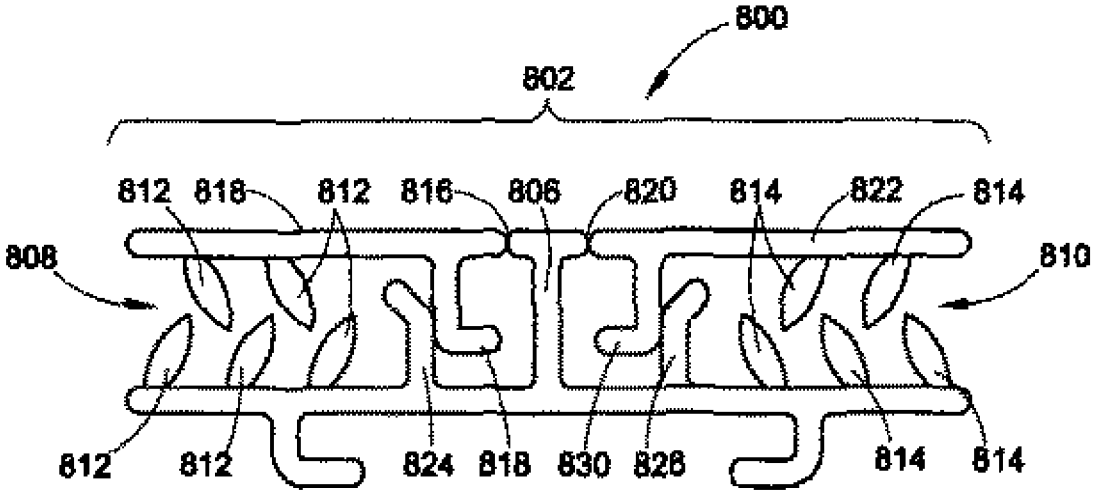
FIG. 17 is a plan view of an alternate embodiment of an intermediate or third sign holder for a sign display system including a first and a second hinged wall portion for receiving an end of each of a first and a second associated sign, respectively.

With reference to FIG. 17, another embodiment of a third or intermediate sign holder 800 is there shown. The third or intermediate sign holder 800 is similar to the third sign holders 138 (FIG. 2), 206 (FIG. 5), 306 (FIG. 6) of the previously described embodiments in that it includes a first side wall 802 which is spaced apart from a second side wall 804 and the first and second walls 802, 804 are joined by a third or connecting wall 806. In addition, these third sign holders are similar in that an end of two separate associated display signs may be securely held via a first sign engaging portion 808 and a second sign engaging portion 810. As with the previous embodiments, each sign engaging portion 808, 810 may include a plurality of spaced fins 812, 814.

However, the main distinguishing characteristic of the third sign holder 800 involves the use of a first hinge 816 for pivotally securing a first portion 818 of the first wall 802 with respect to the second wall 804. Similarly, a second hinge 820 is provided for pivotally securing a second portion 822 of the first wall 802 with respect to the second wall 804. The hinges 816, 820 may be living hinges that can comprise a strip of flexible material. As such, the first and second wall portions 818, 822 are moveable between a first or closed position and a second or open position. Furthermore, a first latch 824 and a second latch 826 are secured to the second wall 804 for slidably engaging a first and a second catch 828, 830 which are secured to the respective first and second wall portion 818, 822 of the first wall 802. The first and second latches 824, 826 and the first and second catches 828, 830 cooperate to securely retain the respective first and second portions 818, 820 of the first wall in the closed position. In the previous embodiments, a sign end portion must be forcibly inserted into or removed from the respective sign engaging portions of the previous embodiments. By contrast, the third or intermediate sign holder 800 allows for less traumatic insertion or removal of the associated display sign.

By way of example, the first and second wall portions of the first wall 802 are placed into the open positions allowing the end portions of two separate signs to be gently laid into place within the respective sign engaging portions 808, 810. Once the end portions of the signs are appropriately situated, the first and second wall portions 818, 820 are then snapped into the closed position. Removal of the sign end portions is opposite of the insertion process. As such, rather than the user struggling to remove or insert the sign end portions and potentially destroying the associated display sign in the process, the user need only flip open or snap closed the first and second wall portions 818, 820 to less traumatically remove or insert the associated sign end portions. The sign holder 800 can also be coextruded from different types of thermoplastic material, as is known in the art.

Figure 18:
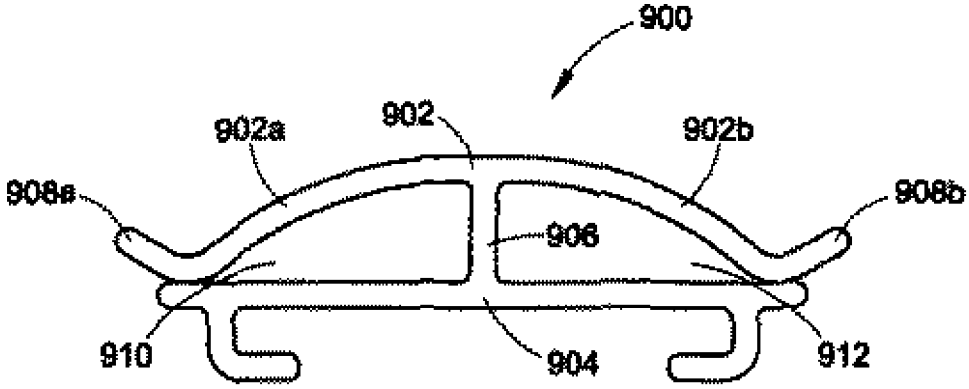
FIG. 18 is a plan view of an alternate embodiment of an intermediate or third sign holder for a sign display system including a first and a second clip portion for receiving an end of each of a first and a second associated sign, respectively.

With reference to FIG. 18, yet another embodiment of an intermediate or third sign holder 900 is shown. The sign holder 900 can include a first relatively flexible side wall portion 902, a relatively rigid second side wall 904 and an intermediate or connecting wall 906. The first wall 902 is further divided into a first portion 902*a* and a second portion 902*b*. Both the first and second portions 902*a*, 902*b* curve rearwardly from a central region proximal to the connecting wall 906 toward the second wall 904. The first and second wall portions 902*a*, 902*b* may be fabricated from a resilient, yet flexible material allowing the respective flared tip portions 908*a*, 908*b* to bend in a forward direction thus permitting access to a first sign engaging portion 910 and a second sign engaging portion 912 while maintaining a bias towards the second wall 904. During insertion of the sign end portions, the respective tip portions 908*a*, 908*b* can be pulled forward slightly to facilitate the insertion of the sign end portions. Once released, the tip portions 908*a*, 908*b* of the first wall 902 will maintain a compressive force on the respective sign end portions so as to prevent the one or more signs from slipping out. In other words, a pinching effect is achieved. Of course, the pinching effect can also be achieved by allowing both side walls 902 and 904 to be somewhat flexible and biased toward each other. The two walls would then be pried apart to allow the insertion of a sign. Removal of the one or more signs may be accomplished by withdrawing the sign from the sign engaging portions 910, 912 and by overcoming the friction generated by the compressive forces therein.

It should be noted that the individual components of the sign holder and sign display systems discussed herein could be fabricated from a variety of suitable materials using a variety of techniques. For example, any suitable conventional thermoplastic material may be used and the individual components could be formed in a single molding operation or in a continuous extruding operation, such as via co-extrusion. Of course other materials such as metallic alloys and or composite materials could also be used when weight, strength, durability, and or compactness are of particular relevance to a given application. In addition, a combination of different materials may used to achieve the resiliency and or flexibility requirements of the sign holder components. For example, the hinge and the fins may be made from a highly flexible yet durable material while the first wall, the second wall, and or the connecting wall may be made from a relatively rigid material.

The exemplary embodiments of the invention have been described with reference to the preferred embodiments. Obviously, modifications and alterations will occur to others upon reading and understanding the preceding detailed description. It is intended that the embodiments of the invention be construed as including all such modifications and alterations insofar as they come within the scope of the appended claims or the equivalents thereof.

The invention claimed is:

1. A display system for selectively attaching an associated sign to an associated merchandise fixture, the system comprising:

a first bracket including a first fixture engaging protrusion for selectively engaging an opening in a first portion of the associated merchandise fixture;

a first sign holder including a first body having a length, a bracket engaging portion and a sign engaging portion comprising a first channel which extends the length of the first body, the bracket engaging portion of the first sign holder capable of being selectively mounted to the first bracket and the sign engaging portion releasably holding a first side edge of an associated sign;

a second bracket including a fixture engaging protrusion for selectively engaging an opening in a second portion of the associated merchandise fixture;

a second sign holder including a second body having a length, a bracket engaging portion and a sign engaging portion comprising a second channel extending the length of the second body, the bracket engaging portion of the second sign holder capable of being selectively mounted to the second bracket and the sign engaging portion releasably holding a second side edge of the associated sign; and wherein the first and second brackets and the first and second sign holders cooperate to removably secure the first and second side edges of the associated sign to the associated merchandise fixture, wherein the first and second bracket fixture engaging protrusions are oriented generally perpendicular to the sign engaging portions of the first and second sign holders.

2. The display system of claim 1, wherein the bracket engaging portion of the first and second sign holders includes a generally C-shaped channel for engaging a respective generally planar surface of the first and second bracket.

3. The display system of claim 1, wherein a body of the first and second brackets includes a tip portion, a telescopic portion, and a base portion, the telescopic portion including a first elongated member and a second elongated member, the first and second elongated members being slidably engaged to space apart the tip portion from the base portion.

4. The display system of claim 1, wherein the associated merchandise fixture comprises one of a pegboard, slatwall, and an upright support and wherein the fixture engaging portion of the bracket includes a projection adapted to engage one of the associated pegboard, slatwall, and upright support of the associated merchandise fixture.

5. The display system of claim 1, wherein the sign engaging portion of the first and second sign holders includes a plurality of spaced retaining members for releasably holding the respective first and second ends of the associated sign.

6. The display system of claim 1, wherein the fixture engaging protrusions of the first and second brackets include a C-shaped clip for selectively engaging a forward facing panel of the associated merchandise fixture, the clip comprising a first leg, a second leg, and a threaded fastener disposed transversely in one of the first or second leg, the first and second legs capable of engaging the forward facing panel of the associated merchandise fixture and the threaded fastener capable of spacing apart the first leg from the second leg.

7. The display system of claim 1, wherein the fixture engaging protrusions of the first and second brackets includes a C-shaped clamp having a threaded fastener for selectively attaching the first and second brackets to the associated merchandise fixture.

8. The display system of claim 1, wherein the fixture engaging protrusions of the first and second brackets include at least one tab for selectively engaging at least one tab aperture in the associated merchandise fixture.

9. The display system of claim 1, wherein the sign engaging portions of the first and second sign holders include a plurality of inclined interdigitated fingers for releasably holding the respective first and second end of the associated sign.

10. The display system of claim 1, wherein at least one of the first sign holder and the second sign holder comprises a plurality of spaced fins.

11. The display system of claim 10, wherein a first set of the plurality of fins is mounted to the first sign holder and a second set of the plurality of fins is mounted to the second sign holder.

12. The display system of claim 1, further comprising a hinge for movably mounting a first portion of at least one of the first and second sign holders in relation to a second portion thereof.

13. The display system of claim 12, further comprising a latch for securing the first portion in one orientation in relation to the second portion.

14. The display system of claim 1, wherein at least one of the first and second sign holders comprises a curved wall, said curved wall cooperating with a second wall to grip a portion of the associated sign between them.

15. A display system for selectively attaching an associated sign to an associated merchandise fixture, the system comprising:

a first bracket including a first fixture engaging protrusion for selectively engaging an opening in a first portion of the associated merchandise fixture;

a first sign holder including a first body having a length, a bracket engaging portion and a sign engaging portion of the first channel which extends the length of the first body,the bracket engaging portion of the first sign holder capable of being selectively mounted to the first bracket and the sign engaging portion releasably holding a first side edge of an associated sign;

a second bracket including a fixture engaging protrusion for selectively engaging an opening in a second portion of the associated merchandise fixture;

a second sign holder including a second body having a length, a bracket engaging portion and a sign engaging portion comprising a second channel extending the length of the second body, the bracket engaging portion of the second sign holder capable of being selectively mounted to the second bracket and the sign engaging portion releasably holding a second side edge of the associated sign;

wherein the first and second brackets and the first and second sign holders cooperate to removably secure the first and second side edges the associated sign to the associated merchandise fixture; and an intermediate bracket and an intermediate sign holder, the intermediate bracket being selectively engaged to the support surface of the associated merchandise fixture and the intermediate sign holder being selectively mounted to the intermediate bracket, the intermediate sign holder including a first sign engaging portion for supporting an end of a first associated sign and a second sign engaging portion for supporting an end of a second associated sign, the first and second associated signs being disposed between the first and second sign holders and the intermediate sign holder being disposed between the first and second associated signs.

16. The display system of claim 15, wherein each of the first and second sign engaging portions of the intermediate sign holder includes a hinge, each hinge permitting a wall of the respective first and second sign engaging portions to pivot between an open position and a closed position.

17. The display system of claim 16, wherein each of the first and second sign engaging portions further comprises a latch for securing the wall of the respective first and second sign engaging portion in the closed position.

18. The display system of claim 15, wherein at least one of the sign engaging portions of the first sign holder, the second sign holder and the intermediate sign holder comprises a plurality of spaced fins.

19. The display system of claim 18, wherein a first set of the plurality of fins is mounted to a first wall of the at least one of the first and second channels and a second set of the plurality of fins is mounted to a second wall of the at least one of the first and second channels.

20. The display system of claim 15, wherein the respective first and second channels are defined between a pair of spaced walls oriented parallel to a longitudinal axis of the first body and a longitudinal axis of the second body.

21. The display system of claim 20, further comprising a hinge for movably mounting a portion of one of the pair of spaced walls in relation to another of the spaced walls.

22. The display system of claim 15, wherein one of the sign engaging portions of the first and second holders comprises a curved section of a first wall, said curved section cooperating with a second wall to grip a portion of an associated sign between them.

* * * * *